United States Patent [19]

Haour et al.

[11] Patent Number: 4,529,628

[45] Date of Patent: Jul. 16, 1985

[54] METHOD FOR THE CONTINUOUS COATING OF AT LEAST ONE PORTION OF AT LEAST ONE OF THE FACES OF A METALLIC SUBSTRATE

[75] Inventors: Georges Haour, Geneva; Michel Kornmann; Wagnieres Willy, both of Grand-Lancy, all of Switzerland

[73] Assignee: Battelle Memorial Institute, Carouge, Switzerland

[21] Appl. No.: 397,152

[22] Filed: Jul. 12, 1982

Related U.S. Application Data

[63] Continuation-in-part of Ser. No. 247,533, filed as PCT CH 80/00090, Jul. 28, 1980, published as WO 81/00419, Feb. 19, 1981, § 102(e) date Mar. 31, 1981, abandoned.

[30] Foreign Application Priority Data

Jul. 31, 1979 [CH] Switzerland ..... 7034/79

[51] Int. Cl.[3] ..... C23C 1/02

[52] U.S. Cl. ..... 427/319; 427/321; 427/209; 118/407; 118/401; 118/410; 118/DIG. 2

[58] Field of Search ..... 118/407, 401, 410, DIG. 2; 427/321, 209, 319, 320

[56] References Cited

U.S. PATENT DOCUMENTS

| | | | |
|---|---|---|---|
| 2,598,908 | 6/1952 | Grimson | 118/401 |
| 2,937,108 | 6/1960 | Toye | 427/319 |
| 3,179,536 | 4/1965 | Martinek | 118/407 |
| 3,201,275 | 8/1965 | Herrick | 118/401 |
| 3,522,836 | 8/1970 | King | 118/401 |
| 3,776,297 | 12/1973 | Williford | 118/401 |

*Primary Examiner*—Sam Silverberg

*Attorney, Agent, or Firm*—Karl F. Ross; Herbert Dubno

[57] ABSTRACT

The coating device comprises a furnace (1) comprising a crucible (4) and a lateral distribution conduit (3) whose outlet communicates with an externally open release aperture (2) serving to distribute the molten metal over the entire width of the metal strip (6) to be coated. This strip (6) is entrained from a supply spool (7) to a storage spool (8) and passes over a positioning roll (10) mounted opposite to the release aperture (2), the spacing between this roll and the edge of the release aperture being adjustable by means of a screw (15). A bank of burners (16) is located opposite to the reverse of the strip (6) and upstream of the release aperture (2) in order to heat the strip before it passes in front of the release aperture (2). A molten metal bath is thus constantly maintained between this release aperture (2) and the face to be coated of the strip (6) which is covered with a layer of metal during its displacement.

3 Claims, 8 Drawing Figures

FIG. 1
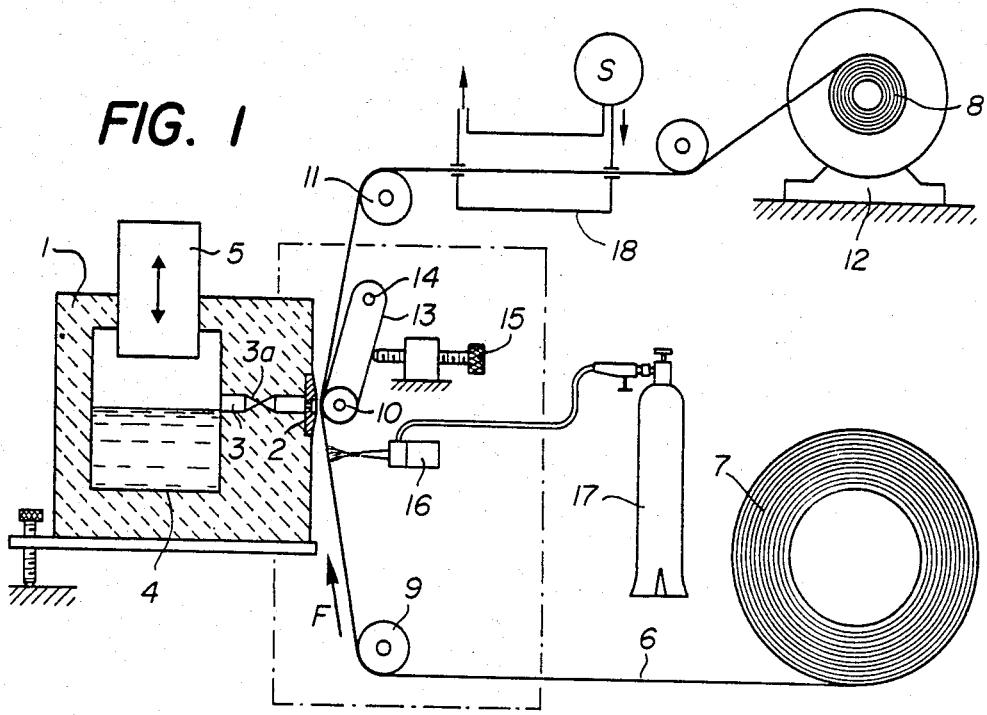
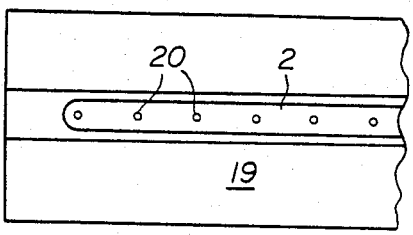
FIG. 3
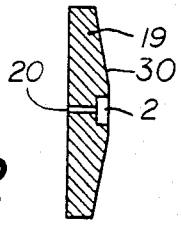
FIG. 2
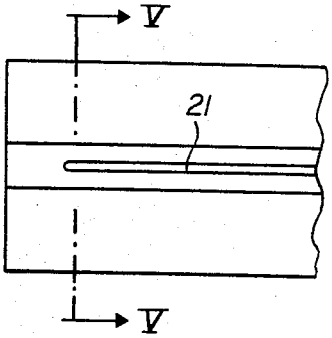
FIG. 4
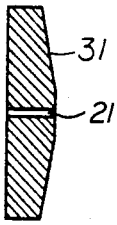
FIG. 5

FIG. 6
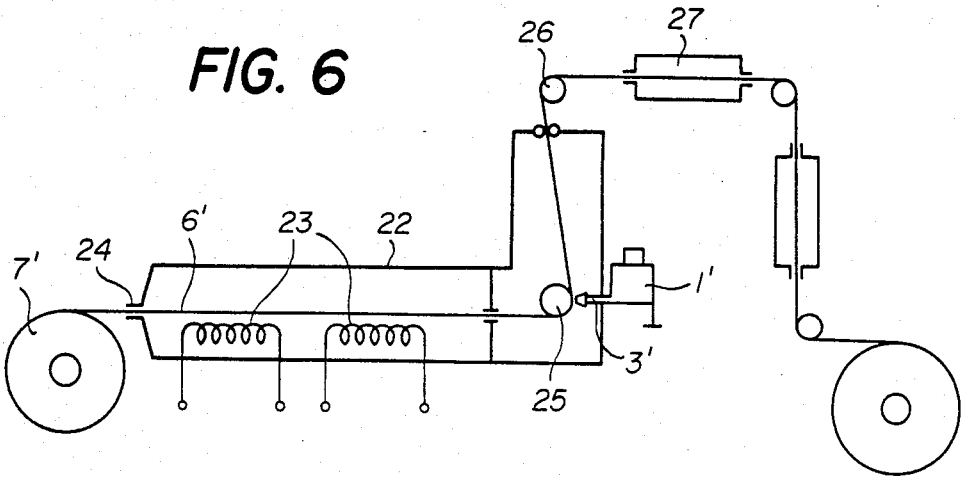
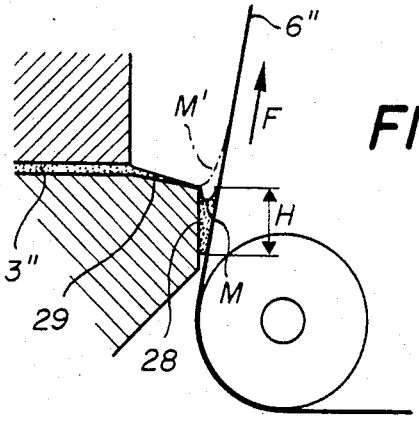
FIG. 8
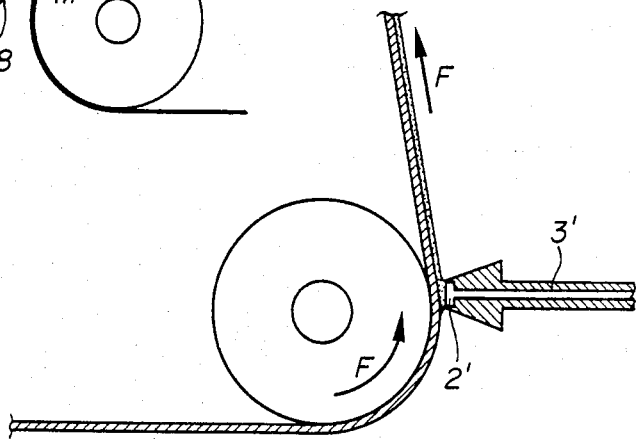
FIG. 7

METHOD FOR THE CONTINUOUS COATING OF AT LEAST ONE PORTION OF AT LEAST ONE OF THE FACES OF A METALLIC SUBSTRATE

CROSS-REFERENCE TO RELATED APPLICATION

This application is a continuation in part of our application Ser. No. 247,533 (now abandoned) filed as PCT CH 82/00090, Jul. 28, 1980, published as WO 81/00419, Feb. 19, 1981, § 102(e) date Mar. 31, 1981, the benefit of which is claimed pursuant to 35 USC 120. Applicants also claim the benefit of the PCT application filed in Switzerland on July 28, 1980 (PCT/CH/80 00090) and, under 35 USC 119 and the International Convention, the priority of the Swiss application No. 7034/79 filed July 31, 1979.

FIELD OF THE INVENTION

The invention relates to the coating of sheet metal with another metal and in particular to a method which enables the partial coating of the sheet.

BACKGROUND OF THE INVENTION

Galvanized sheet metal is generally produced by immersing the sheet in a bath of molten zinc and providing a coating on both faces of the sheet. This method of manufacture has been fully developed and enables the production of sheet which is protected against corrosion for many years.

However, a new market has for some time provided outlets for sheet which is galvanized on one face and not on both. This market is provided by the automobile industry, in which the increasingly frequent salting of roads in winter causes an increased rate of corrosion of vehicle bodywork. Although in many cases in the building industry, sheet galvanized on both faces is tolerable, this is not the case in the automobile industry as it is not possible to provide a sufficiently smooth layer of paint on a layer of zinc. This layer of zinc is also disadvantageous with respect to the spot welding of the sheet.

Various solutions have already been proposed for coating the sheet on one of its faces alone. Franch Patent Application No. 2,344,640 thus relates to a method in which a bath of molten zinc is provided and the metal strip is passed close to the free surface of the zinc bath so that the surface tension and the wettability of the molten metal enable the formation of a meniscus on the free surface of the bath which contacts the face of the strip which is facing towards it.

In accordance with the method disclosed in the French Patent Application No. 2,348,278, the strip to be coated is passed through a bath of molten zinc, and the face of the sheet which is not to be coated is simultaneously contacted with a cylinder rotating about an axis parallel to the level of the bath, the contact between the face and the cylinder being maintained for the entire period of immersion of the sheet in the bath.

Japanese patent application No. 77-151,638 also proposes to mask the face which is not to be coated.

Belgian Pat. No. 859,420 relates to a method in which a thin jet of molten zinc is sprayed onto the face of the strip of sheet to be coated.

The first two techniques mentioned above do not enable the thickness and uniformity of the deposited layer to be controlled. In addition, in the second of these approaches, difficulties arise from the accumulation of zinc on the portions of the cylinder which project beyond the longitudinal edges of the strip of metal, as well as with respect to protecting the other non-coated face of the sheet.

The method which makes use of masking generally requires the subsequent removal of the coating designed to mask the non-galvanized face.

The method using a zinc jet is difficult to carry out, as it is very difficult to form a very thin jet which is perfectly laminar, especially if it is desired to produce a coating having a thickness in the range of some tens of microns.

Further proposals relating to the single face coating of substrates have been made.

French Pat. No. 1,153,715 relates to a device for the metallic coating of metal strip on one or both faces in which the molten metal is contained in a crucible having outlet lips pressed against the strip so that the width of the orifice formed between the two lips is small enough to cause any metal which is applied to the strip to be entrained from the application device as a result of the displacement of the strip, under the effect of the capillary forces resulting from the surface tension between the molten metal and the strip to be coated. In this way the displacement of the strip, which is wetted by the molten metal, causes the progressive removal of the metal from the crucible. A device of this type is disadvantageous for several reasons. For example the required contact between the distribution lips of the crucible and the strip to be coated causes the lips to become worn.

Moreover the fact that only the capillary forces resulting from the surface between the molten metal and the strip are used to pump the liquid from the crucible limits the coating speed. The possibilities for adjusting layer thickness with a device of this type are also restricted.

A further device based on the pumping action caused by capillary forces is disclosed in the U.S. Pat. No. 3,201,275 and in the German Auslegeschrift No. 1,080,373.

Lastly, in accordance with the U.S. Pat. No. 1,973,431, liquid metal is caused to flow through a passage whose cross-section corresponds to that of the layer to be deposited, the outlet end of this passage itself being located at a distance from the substrate which is exactly equal to the thickness of the layer to be deposited. This method is similar to extrusion methods and is very difficult to carry out unless considerable pressure is exerted on the metal. In addition, bearing in mind phenomena related to capillarity, this method is restricted to relatively large coating thicknesses.

Attention should also be given to U.S. Pat. No. 2,937,108 which describes a system for maintaining a molten mass of a metal adapted to coat a strip against a portion of this stretch whose speed of linear displacement is selected as a function of the thickness desired of the coating. This mass of metal is fed by at least one and possibly two rollers which may be immersed or may dip into a bath of the metal, or which may be in contact with a roller dipping into the metal bath. In either case, the molten metal is entrained by the surface of a roller into contact with the strip so that a meniscus is formed between a vertical bath of the strip and a portion of the surface of a roller adjacent this strip.

For a given geometry, especially for a given diameter of the coating roller, the mass of molten metal maintained against the strip is constant. Under these conditions the thickness of the deposit formed on the surface of the strip by molten metal cannot be varied except as a function of the speed of displacement.

This limitation in the adjustability constitutes a significant disadvantage from the point of view of industrial application of the technique since it is necessary either to operate at less than maximum strip speed (thereby decreasing productivity) or to modify the geometry by changing the parts (at considerable expense) for variation of the thickness. In fact, for reasonably thick coatings, the system of this patent must operate so slowly as to be impractical on a commercial scale.

U.S. Pat. No. 3,522,836 relates to the continuous production of wire from a molten metal which is displaced from a crucible through a horizontal passage which opens towards a cold drum.

A piston is displaced into the molten metal to cause the molten metal to flow through this passage and form a meniscus at the outlet of the distribution passage. As the cold drum rotates in contact with the meniscus, it draws from the latter a strand of the metal, which cools and solidifies on the surface to form the wire.

In this case as well, the possibilities for controlling the flow of the liquid metal are limited by the static equilibrium conditions established by the pressure exerted by the liquid, and the surface tension of the liquid capable of maintaining a stable meniscus. The possibilities of varying the flow are extremely limited and indeed care must be taken with any modification of the operating parameter to avoid the rupture of the meniscus and hence the disturbance of the static equilibrium. Under these conditions, moreover, it is practically impossible to coat a strip with a layer of a metal whose thickness can be varied independently of the speed of displacement of the metallic substrate.

OBJECTS OF THE INVENTION

It is the principal object of the present invention to provide an improved method of coating an elongated metal substrate, e.g. a metallic strip with molten metal to a desired thickness which need not be a function of the speed of displacement of the strip.

A more specific object of the invention is to provide a method of coating of at least one face of a substrate strip which extends the principles of our copending application Ser. No. 247,533.

Still another object of this invention is to provide a method of coating metal strips which will remedy at least partially the various drawbacks enumerated above.

Yet a further object of our invention is to provide an improved method of coating metal strips which allows adjustment of the thickness of the coating while the strip is displaced at an optimum speed which can be independent of this thickness.

SUMMARY OF THE INVENTION

The present invention provides a method for continuously coating a metallic substrate on at least one portion of at least one of its faces with another metal, wherein at least one pressurized stream of this molten coating metal is forced through a distribution aperture extending substantially over the width of the portion of the substrate to be coated. A path is established for the substrate transverse to this width and passing close to the distribution aperture, the substrate being heated to a temperature close to the melting point of the coating metal for a portion of its path. The substrate is entrained along this path in order to successively convey its heated portions opposite to the distribution aperture with the distance between this aperture and the substrate being adjusted such that the surface tension of the molten coating metal and the wettability of the substrate enable the molten metal to form a stable meniscus between this aperture and the substrate. The rate of flow of the stream is adjusted as a function of the required thickness of the coating, for a given speed of passage of the substrate.

The invention also relates to a device for carrying out this method, which comprises a molten coating metal source, at least one distribution conduit for this metal, means for adjusting the spacing between the edge of the said release aperture and the face of the strip to be coated, means for heating the portion of the strip located immediately upstream of this release aperture and means for adapting the rate of flow of the molten metal and the speed of the strip as a function of the required thickness of the coating.

We have found, most surprisingly, that it is possible to control the thickness of the coating of metal applied to an elongated substrate strip coated in the aforementioned manner independently of the speed of displacement of the strip, or, put otherwise, for a given speed of displacement of the strip.

As the preceding discussion has shown, up to now it has been necessary to vary the speed of the strip in order to vary the thickness of the coating applied thereto. With the claimed invention, however, it is possible, once the strip speed has been selected to vary the thickness of the coating by controlling the flow of metal fed to a mass thereof forming a meniscus against a metal strip over the width thereof between the nozzle assembly which extends over the width of this strip.

This is accomplished by maintaining, instead of a static equilibrium as has been suggested in the past, a dynamic equilibrium between the rate of flow of the molten metal to this meniscus, the movement of the coating away from the meniscus on the strip, and the various forces involved such as the gravitational force which tends to drop the coating metal from the meniscus, the surface tension of the molten metal and the wettability of the substrate by the molten metal.

According to an important feature of the invention, an acute angle is formed between the vertical wetting surface of the nozzle which is juxtaposed with the strip, and the strip extending way from this surface, thereby ensuring that the gap between the nozzle and the strip will converge downwardly. This convergence cooperates with the surface tension of the molten metal to provide a wide range of flows of the molten metal between the surface and the strip so that the thickness of the coating which is ultimately formed is flow-dependent and not exclusively a function of the speed of the strip. Preferably this surface lies below the outlet of the passage delivering the molten metal to the gap.

Key to the present invention, therefore, is the formation of the outlet for the molten metal adjacent a wetting surface which is juxtaposed with the strip and which defines the gap therewith, this gap preferably converging downward.

BRIEF DESCRIPTION OF THE DRAWING

The attached drawing shows diagrammatically and by way of example, an embodiment and variants of the device for carrying out the method of the present invention. In the drawing:

FIG. 1 is a lateral view of an embodiment of the device, partly in section;

FIG. 2 is a section which shows an enlarged detail of this embodiment;

FIG. 3 is an elevation showing a detail of FIG. 2;

FIG. 4 is a partial elevational view of a variant of a detail of the device of FIGS. 1 to 3;

FIG. 5 is a section along the line V—V of FIG. 4;

FIG. 6 is a lateral view of a variant of FIG. 1;

FIG. 7 shows in section an enlarged detail of this variant and

FIG. 8 is a diagram illustrating an important concept in accordance with the present invention.

SPECIFIC DESCRIPTION

The device shown in FIG. 1 comprises a furnace 1 of known design for producing molten zinc. This furnace has a lateral distribution conduit 3 which communicates at one end with an externally open release aperture 2, while its other end communicate with a crucible 4 containing molten metal.

A level regulator for the molten metal contained in this crucible constituted by a vertically displaceable piston 5 enables the molten zinc to be caused to flow into the conduit 3 in order to supply the release aperture 2. An adjustment valve 3*a* positioned in the conduit 3 enables the rate of flow to be adjusted with a high degree of accuracy.

A strip 6, formed for example from steel sheet, wound at one end on a supply spool 7 and at the other end on a storage spool 8 and guided by three rolls 9, 10, 11, is entrained by a motor 12 and passes in front of the release aperture 2. The spacing between the strip 6 and the edge of the release aperture 2 may be adjusted.

For this purpose each of the ends of one of the rolls 10 having a positioning function is fixed to the end of an arm 13 mounted pivotably about a fixed axis 14 which bears against an adjustable stop screw 15. A bank of gas burners 16, supplied from a gaseous fuel source 17, is juxtaposed with the face of the strip 6 opposite to that facing the release aperture 2 and in the portion of the path of the strip, whose direction of displacement is indicated by the arrow F, located immediately upstream of the release aperture 2. This bank of burners 16 is designed to increase the temperature of the strip 6 to approximately the temperature of the molten zinc, in order to ensure that the strip 6 is adequately wetted by the liquid zinc.

The portion of the installation surrounded by dot-dash lines is placed under a controlled $H_2+N_2$ atmosphere designed to prevent oxidation of the substrate. As can be seen from FIGS. 2 and 3, the release aperture 2 has a particular shape which plays a considerable part in successfully carrying out the method as it is designed to form a zone for distributing the molten metal over the width of the strip.

For this purpose, the release aperture 2 is formed by an elongated slot disposed transverse to the longitudinal axis of the strip 6, this slot having a length which is slightly less than the width of the strip 6 to be coated. This slot is provided in a plate 19 which extends across the aperture 2. In this example, the depth of this slot is approximately 2 to 3 mm and its width is 3 mm.

A set of connection conduits 20 communicates with base of this release aperture 2 and connects it to the conduit 3. These connection conduits 20 are formed by bores having a diameter of 0.8 mm and have a mutual spacing of 10 mm in this example. They are designed to cause a loss of head at the outlet of the conduit 3 and to facilitate the distribution of the molten zinc over the entire length of the release aperture 2.

As can be seen from FIGS. 1, 2 and 5, above the outlet 2, 21 of the nozzle means which opens horizontally toward the heated strip 6, wetting surfaces 30 and 31 may be provided to form downwardly converging gaps with the strip receiving molten metal. Preferably, however, this acute-angle or converging gap has the configuration described in connection with FIG. 8 and can function similarly. In all cases, however, the wetting surfaces 28, 30, 31 should be planar and extend the full width of the strip.

In this example, the connection conduits have a mutual spacing of 10 mm, but this spacing is not critical. In practice, the spacing and the number of the connection conduits should be selected as a function of the required rate of flow and in such a way that they cause a loss of head such that the molten zinc does not emerge in the form of a jet, the upstream pressure resulting solely from the height of the liquid zinc located above the input level of the conduit 3.

This loss of head is solely designed to distribute the flow uniformly over the entire length of the release aperture 2 so that it is always filled with molten zinc during the coating process. The external face of the plate 19 is bevelled on both sides of the slot 18 in order to prevent the molten zinc from spreading over this face when the strip 6 is located in the vicinity of the edge of the aperture 2 and is longitudinally displaced. The strip 6 in addition forms an angle of approximately 10° to vertical on both sides of the roll 10. It should also be noted that supplying the liquid zinc through a horizontal conduit, while the strip to be coated is substantially vertical and is displaced upwardly opposite the release aperture 2, constitutes an advantageous arrangement.

The zinc flow may in this way be readily controlled and, in particular, the direction of displacement of the strip causes an entrainment of the liquid zinc as a result of the wettability of the heated strip which opposes the flow of zinc by gravity such that these two opposing forces may be dynamically balanced. Laboratory tests have been successfully carried out using the apparatus described above.

A strip of stainless steel having a width of 10 cm was used in these tests. Stainless steel was selected for these tests so that it was possible to work without a controlled atmosphere for reasons of simplicity. As the wettability of a strip of ordinary grade steel heated under a non-oxidizing atmosphere is better than that of nonoxidizable steel, all the tests carried out in this way may be transposed to an industrial plant using ordinary grade steel sheet.

The temperature of the zinc in the crucible was firstly brought to between 450° to 470° C. The steel strip 6 was brought by the roll 10 controlled by the adjustment screw 15 acting on the pivoting arm 13, into contact with the edge of the aperture 2. The piston 5 was introduced into the zinc bath in the crucible 4 and the level of the zinc exceeded the level of the conduit 3 and the zinc flowed in the direction of the release aperture 2.

It passed through the conduits 20 and spread into the release aperture which is filled. The roll 10 was then moved backwards by means of the screw 15 and the motor 12 was started, during which time the bank of gas burners was ignited so that the strip was brought, on reaching the release aperture 2, to a temperature close to that of the molten zinc.

In this example the temperature of the strip may be in the region of 400° C. so that the zinc is not cooled when it contacts the strip which would prevent it from forming a uniform coating and would lead to blockage of the strip as a result of an accumulation of zinc at the release aperture 2.

The spacing between the edge of the aperture 2 and the surface of the strip to be coated should be sufficient to ensure that the strip does not contact the plate 19.

During the tests which were carried out and with a strip speed of 10 m/min and a layer thickness of approximately 30 μm, it was possible to attain a spacing of 0.8 mm. This spacing is preferably 0.5 to 0.6 mm. Striations or irregularities in the coating were observed when this spacing was increased or decreased. Beyond 1 mm at whatever the speed of the strip, the meniscus between the release aperture 2 and the strip was no longer formed and the metal flowed by gravity.

It has already been mentioned above that the tests carried out on a stainless steel strip in order to simplify the apparatus and its mode of operation, did not provide optimum wetting conditions and that the coating of a steel strip in a reducing atmosphere provides improved wetting.

Consequently the conversion of the laboratory tests into an industrial process does not pose any basic problems and may enable a slight increase of the spacing between the edge of the release aperture 2 and the strip. Leaving this possibility aside, the spacing given above is sufficient to ensure the passage of the strip without contact with the edge of the release aperture 2. The rate of flow of the zinc should be determined as a function of the required coating thickness and the speed of passage, so that the volume of liquid zinc contacting the portion of the strip adjacent to the release aperture 2 is constant.

Providing a continuous coating having a constant thickness over the the entire width of the strip is dependent on maintaining this liquid volume in contact with a portion of the strip 6 over its entire width.

Increasing the width of coating from 10 cm to 1.50 m, which is the present width used in industry does not present any basic difficulty. It is possible to use either a set of modules formed of plates 19 disposed side by side, or to extend the plate 19 and the release aperture 2 to cover the entire width or to juxtapose longer modules than those used in the tests side by side, these modules being shorter than the total width of the sheet to be coated. It is also possible to coat a single portion of the width of the strip and thus provide cost economies. In this case the release apertures 2 should be suitably dimensioned and distributed in order to coat certain individual portions of the width of the strip.

Tests in which the thickness of the coating was varied by modifying the rate of flow enabled conversion from a coating of 80 μm on a width of 10 cm with a rate of flow of 1.33 $cm^3/s$ and a speed of passage of 10 m/min to a coating of 30 μm with a rate of flow of 0.5 $cm^3/s$. Under laboratory conditions it was possible to decrease this coating thickness to 20 μm. The top of the range of speeds of passage is limited solely by vibrational problems and not by the nature of the method and at the bottom of the range it may be decreased to a speed of approximately 3 m/min for a rate of flow of approximately 1 $cm^3/s$. This demonstrates the large degree of flexibility of the method of the invention.

A number of variants may be envisaged, one of these being shown in FIGS. 4 and 5. A slot 21 may be provided in place of the release aperture 2 and the connection conduits 20. A set of conduits 20 may be provided in place of the slot 21 without these conduits communicating with a release aperture 2. It is also possible to reduce the number of conduits 20 and increase their mutual spacing while possibly increasing their cross-section. The advantage of providing the liquid zinc bath adjacent to the face of the strip 6 to be coated is that, as a result of its positioning, the zinc is caused to flow by gravity and the combined effect of the wettability of the strip and the subsequent entrainment due to its upward displacement.

Substantially the same conditions are therefore to be found as in the known technique of coating on both faces, with a uniform coating thickness and the possibility of modifying the thickness at will by adjusting the rate of flow or the throughput speed. There was no trace of zinc to be observed on the reverse of the strip in any of the tests which were carried out.

In the case of an industrial plant in which the coating speed is higher, it is convenient to provide a cooling station, for example nitrogen cooling, by circulating nitrogen in a conduit 18 from a nitrogen source S, as shown in FIG. 1. It is also possible to provide a regulation system designed to control the speed of passage of the strip 6 and the flow of zinc through the valve 3*a* as a function of a given coating thickness.

The variant of the device shown in FIGS. 6 and 7 shows an embodiment in which a furnace 1' and its distribution conduit 3' one end of which communicates with a release aperture 2' similar to the release aperture 2 of FIGS. 1 to 3, are mounted in an industrial zinc coating plant essentially comprising a chamber 22 with a reducing atmosphere containing a heating station 23 operated either by electricity or gas. One end of the chamber 22 has an inlet 24 for the passage of the strip 6' supplied by the roll 7'. A guide roll 25 is disposed in the vicinity of the release aperture 2' after which the strip 6' is displaced towards the outlet 25 of the chamber 22 to a further guide roll 26 disposed between the chamber 22 and a cooling station 27.

In FIG. 7 it should in particular be noted that the strip 6' is supplied horizontally to the guide roll 25 and that it surrounds this roll at an angle greater than 90° so that it leaves this roll with a slight inclination of a few degrees in order to facilitate the definition of the meniscus in the direction of displacement F of the strip 6', as mentioned above with respect to the embodiment of FIG. 1. The remainder of the plant is known to the person skilled in the art and lies outside of the scope of the invention and is therefore not described in detail.

The method described above, although designed for one-face coating, may also be used for two-face coating when a second coating device is applied opposite the other face. These coatings could, for example, be of different thicknesses on opposite sides of the strip. It would also be possible to use this method to coat both faces of a strip leaving uncoated portions on one or both faces.

Among the advantages of the method described above, it should be emphasized that the blotting process required to render the thickness uniform in known methods is not required. Although the examples given above all relate to zinc, it is obviously possible to use the same process to form coatings of lead or tin or even aluminum, although in this last case the material used for the plate 19 must be selected, bearing in mind the melting point of aluminum and its corrosive action at this temperature.

In the embodiment illustrated in FIG. 8, the distribution passage 3'' opens at a face 29 forming a shoulder which slightly converges slightly downwardly toward the rising portion 6'' of the strip. Extending downwardly from the end of the ramp 29, we provide a wetting surface 28 which is vertical and is inclined at an acute angle to the substrate 6''.

The strip 6'' can be disposed at a location of about one centimeter from the end of the passage 3''. The inclination of the ramp 29 from the horizontal can be several degrees and the acute angle defined between the surface 28 and the strip 6'' is of several degrees as well.

As a result of this configuration, metal flowing from the passage 3'' can flow along the ramp 29 and then into the gap which is between the surface 28 and the substrate 6'' by gravity, assuming for the moment that the substrate 6'' is at rest.

When the substrate 6'' is displaced in the direction of the arrow F at the minimum speed of several meters per minute, an equilibrium is established between the surface tension of the liquid metal, the wettability of the substrate, the wettability of the surface 28, and the speed of the substrate which can equilibrate with the gravitational force to retain the molten mass stability between the substrate 6'' and the surface 28. As is the case with the embodiment of FIG. 7, the acute angle formed between the wetting surface 28 and the substrate 6'' can be about 1° to 10° and the apex can lie below the surface 28.

The role of the surface 28 is the same as that of members 2 and 2' previously described except that rims are not used.

With a greater flow rate, the meniscus may assume the position M', resulting in an increased thickness of coating. At a lower flow rate, the meniscus assumes the position M. In practice, therefore, the thickness is a function of the height H of the molten metal in the gap.

Utilizing the system shown in FIG. 8, it is possible to vary the thickness of the metal coating applied to a steel strip between 5 μm and 80 μm. For a coating of a thickness of 5 μm on a steel band having a width of 10 cm running at a speed of 20 m/min, a zinc flow of 0.53 l/hour with molten zinc at a molten temperature of 450° can be obtained with a band temperature of 480° C. The thickness can be raised to 50 μm/hour under the same conditions simply by increasing the flow to 5.3 l/hour. The process is carried out in a reducing atmosphere under industrial conditions.

We claim:

1. A method of continuously coating at least a portion of at least one face of an elongated metallic strip substrate with another metal, said method comprising the steps of:

(a) continuously displacing said substrate along a transport path including at least one upwardly extending stretch;

(b) juxtaposing with said substrate at said stretch the end of a distribution passage for a molten metal adapted to coat said substrate, and disposing opposite said substrate adjacent said end of said distribution passage and over the width of the portion of said substrate to be coated, a wetting surface forming a gap with said substrate adapted to receive molten metal from said distribution passage;

(c) feeding said molten metal through said distribution passage over the width of the portion of said substrate to be coated generally transversely to the direction of displacement of said substrate, thereby disposing said molten metal in said gap in such manner that only gravity acts to deliver the molten metal to said gap and in a downward direction on molten metal in said gap;

(d) heating said substrate before it reaches said gap to a temperature above the melting point of the coating metal;

(e) controlling the distance between said end of said distribution passage and said substrate and the distance between said wetting surface and said substrate so that the surface tension of the molten metal, the wettability of the substrate, the direction and speed of said substrate generate forces opposite to the effect of gravity upon the coating metal for maintaining a dynamic equilibrium of the mass of coating metal in said gap; and (f) controlling the rate of flow of the coating metal to said gap to maintain a desired thickness of coating of the coating metal on said substrate independently of the speed of displacement of said substrate.

2. The method defined in claim 1 wherein an acute angle coverging downwardly is formed between said surface and the portion of said substrate juxtaposed therewith.

3. The method defined in claim 1 or claim 2 wherein said surface is disposed below said end of said distribution passage.

* * * * *